United States Patent [19]

Steele

[11] Patent Number: 4,691,108

[45] Date of Patent: Sep. 1, 1987

[54] IONIZATION DETECTOR

[75] Inventor: Douglas S. Steele, Fairfield, Ohio

[73] Assignee: General Electric Company, Cincinnati, Ohio

[21] Appl. No.: 834,262

[22] Filed: Feb. 27, 1986

Related U.S. Application Data

[63] Continuation-in-part of Ser. No. 565,672, Dec. 27, 1983.

[51] Int. Cl.[4] ..... H01J 47/18

[52] U.S. Cl. ..... 250/385; 250/374

[58] Field of Search ..... 250/385, 374

[56] References Cited

U.S. PATENT DOCUMENTS 4,376,893 3/1983 Whetten ..... 250/385

4,465,933 8/1984 Perez-Mendez et al. ..... 250/385

*Primary Examiner*—Janice A. Howell

*Attorney, Agent, or Firm*—Derek P. Lawrence

[57] ABSTRACT

In an invention detector having an array of detectors, grounding pads are positioned in the spaces between some detectors (data detectors) and other detectors (reference detectors). The grounding pads are kept at zero electric potential, i.e., grounded. The grounding serves to (1) drain away electrons and thereby prevent an unwanted accumulation of charge in the spaces, and (2) cause the electric field lines to be more perpendicular to the detectors in regions near the grounding pads.

6 Claims, 3 Drawing Figures

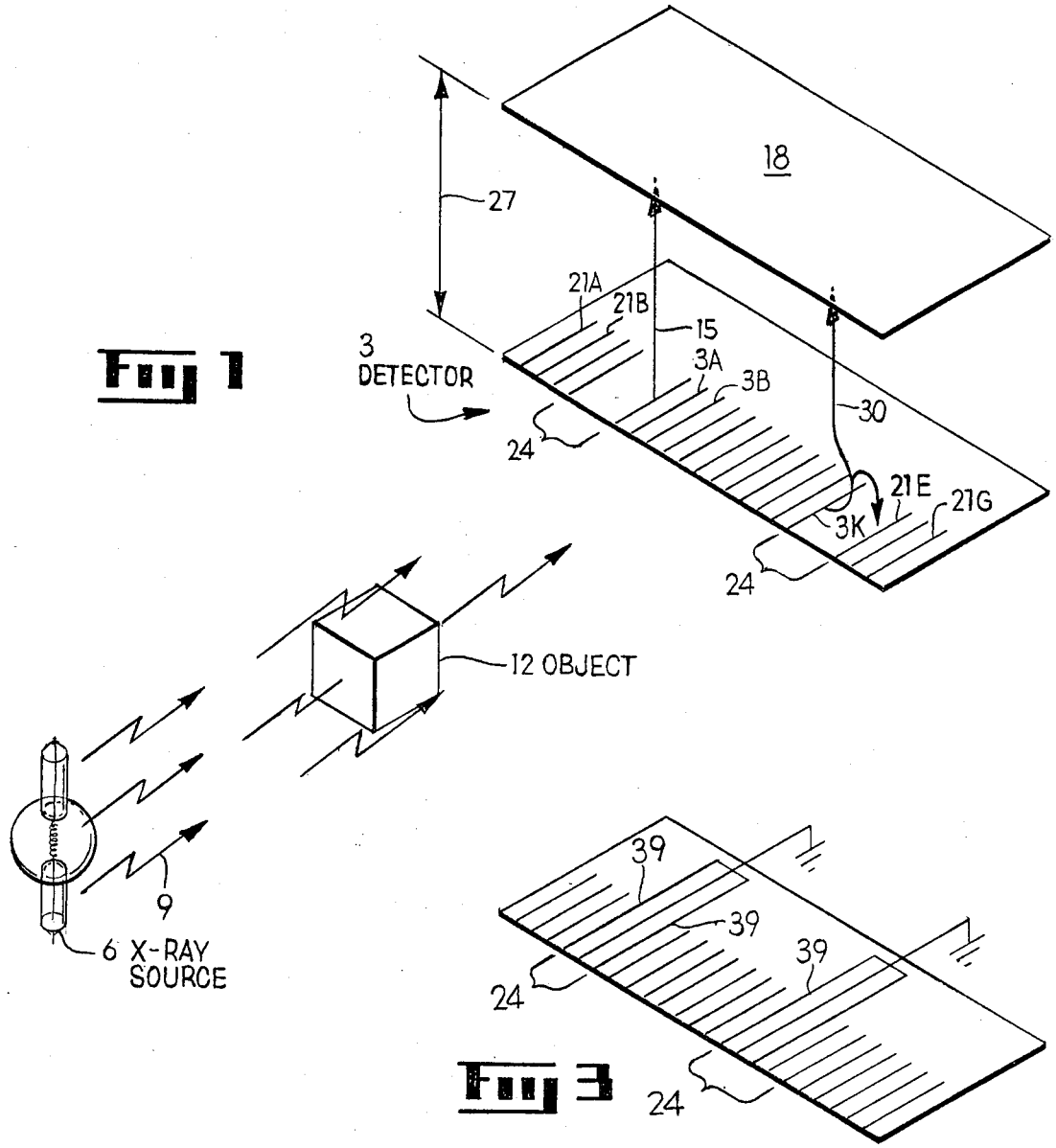
Fig 1
Fig 3
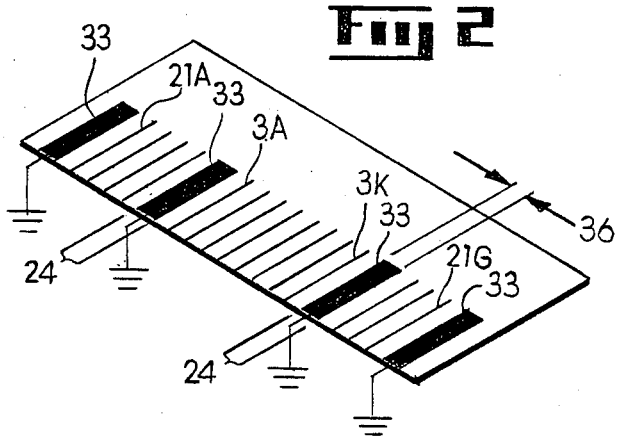
Fig 2

IONIZATION DETECTOR

This is a continuation-in-part of Ser. No. 565,672, filed Dec. 27, 1983.

This invention relates to ionization detectors used in X-ray tomography.

BACKGROUND OF THE INVENTION

A previous patent to the inventor herein and Theodore W. Sippel is U.S. Pat. No. 4,570,071, issued Feb. 11, 1986, and is hereby incorporated by reference.

FIG. 1 illustrates a detector array 3. An X-ray source 6 produces an X-ray beam 9 which passes around and through an object 12 under scrutiny and then enters a chamber (not shown) containing the detector array 3. The chamber is filled with pressurized Xenon gas in the presence of an electric field indicated by arrow 15. The field spans between a charged plate 18 and the detector array 3. The X-rays ionize the Xenon and the electric field drives the electrons resulting from ionization toward individual detector elements 3A–K. The electrons build up a charge on the detectors 3A–K which is a function of the amount of ionization, which is, in turn, a function of the intensity of the incoming x-radiation.

Restated, the charge distributed among the individual detector elements 3A–K indicates the spatial intensity distribution of the incoming x-radiation. Consequently, the charge distribution can be used to construct an image of the object.

The intensity of radiation produced by the X-ray source 6 tends to fluctuate unpredicably over time. Thus, knowledge of the intensity of x-radiation striking the detector array 3 (derived from the charge distribution) is, by itself, insufficient to indicate the X-ray attenuation caused by the object 12: the intensity at the source 6 is not known.

One solution to this problem is to provide additional, reference, detector elements 21A–G at about the same distance from the X-ray source 3 as detectors 3A–K (now called data detectors), but spaced by space 24 such that the reference detectors 21A–G always maintain an unobstructed line of sight to the X-ray source. That is, the object 12 never obstructs the X-rays received by the reference detectors 21A–G. Comparison of the X-ray intensity indicated by the data detectors with that indicated by the reference detectors allows one to infer the attenuation caused by the object 12.

Two problems arise with the space 24 in the detector arrangement shown. The first problem relates to safety. The electric field 15 above the detector elements 31A–K is of the order of 850 volts per 35 milli-inches (distance 27 is about 0.035 inches), or roughly 24,000 volts per inch. Consequently, the electrons produced by ionization will be driven toward space 24, where they will collect. In theory, the electrons will collect until space 24 acquires the same potential as plate 18, namely, 850 volts. However, in practice, dielectric breakdown will probably occur first: The electron accumulation in space 24 will arc over to a neighboring detector element such as 3K, causing damage to the detector array 3 and to associated electronic equipment (not shown).

A second problem is that, under the configuration shown, the electric field will probably resemble the undesirable curved, branched configuration indicated by arrows 30. It is preferred that the electric field lines be straight and perpendicular to the data detector elements 3A–K, as is field-arrow 15. When perpendicular, the fields lines cause the electrons from ionization to travel directly downward toward detectors beneath them, and not toward a detector on one side or the other. This direct travel is necessary for reasons relating to the reconstruction of an image of the object 12 in FIG. 1, and need not be understood here.

OBJECTS OF THE INVENTION

It is an object of the present invention to provide an improved ionization detector.

SUMMARY OF THE INVENTION

In one form of the invention, grounding pads 33 in FIG. 2 are positioned in the spaces 24 between the data detectors 3A–K and the reference detectors 21A–K. The grounding pads are kept at zero electric potential, i.e., grounded. The grounding serves to (1) drain away electrons and thereby prevent an unwanted accumulation of charge in space 24 in FIG. 1, and (2) cause the electric field lines to be more perpendicular to the detectors 3A–K in regions near the grounding pads.

BRIEF DESCRIPTION OF THE DRAWING

FIG. 1 illustrates a schematic of an X-ray system.

FIG. 2 illustrates one form of the present invention.

FIG. 3 illustrates another form of the present invention.

DETAILED DESCRIPTION OF THE INVENTION

FIG. 2 illustrates a detector array of the type described in the parent application. However, in addition, reference detectors 21A–G, of the same size, construction, and spacing as the data detectors 3A–K are separated from the data detectors 3A–K by spaces 24. Conductive grounding pads 33 are contained within the spaces 24 and also at the ends. The grounding pads 33 are constructed of the same material as the detector elements 3A–K, of the same thickness, but wider: dimension 36 is about $\frac{3}{8}$ inch. The grounding pads 33 are kept at an electric potential near that of the detector elements 3A–K in order to prevent electric charge buildup and to maintain perpendicularity of the electric field lines.

In the situation where plate 18 in FIG. 1 is at 850 volts and array 3 is at zero volts (i.e., ground), the pads 33 are preferably also at zero volts. The pads are preferably equipotential with the data detectors 3A–K and the reference detectors 21A–G. (The inventor points out that charge accumulation on the detectors [reference or data], will alter the detector potential, but only by a few millivolts at most. Thus, it is meaningful to state that the pads are equipotential with the detectors.)

The inventor points out that an alternate approach to solve the problems described above would be to use a continuous array of detectors as shown in FIG. 3. That is, there is no empty space 24 as shown in FIG. 1; instead, the space 24 is filled with detector elements 39 identical to the data detectors and the reference detectors. One would ground the detectors 39 in the space 24, as shown in FIG. 3, and then use the data detectors and reference detectors as described above. However, as discussed in the parent application, the construction of the individual detector elements is time-consuming and costly. It is, therefore, more economical to replace the grounded detectors 39 in space 24 in FIG. 3 with the grounding pads described in FIG. 2.

An invention has been described wherein the space separating data detectors and reference detectors in an ionization detector is modified in order to prevent electric charge accumulation and to maintain electric field uniformity. Also, the ends in FIG. 2 of the detector array are similarly treated with grounding pads 33 for similar reasons.

Numerous modifications and substitutions can be undertaken without departing from the true spirit and scope of the present invention.

What is desired to be secured by Letters Patent of the United States is the invention as defined in the following claims.

I claim:

1. An ionization detector, comprising:
a substrate;
a plurality of data detectors positioned on the substrate so as to respond to x-radiation attenuated by passing through an object;
a plurality of reference detectors positioned on the substrate so as to respond to x-radiation which does not pass through the object; and
a conductor located between the data detectors and the reference detectors which is coupled with a means for preventing electron accumulation on the conductor;
whereby the perpendicularity of electric field lines on nearby detectors is enhanced and arcing between the space and the nearby detectors is reduced.

2. An ionization detector for use with an x-ray source in connection with the tomographic examination of an object interposed between the detector and the x-ray source; the ionization detector comprising:
an array of data detector elements;
at least one array of reference detector elements separated from the array of data detector elements by a space;
the arrays being positioned relative to each other such that each reference detector element is located along an unobstructed line of sight to the source when the object is in the interposed position and at least some of the data detector elements are hidden from the source by the interposed object, whereby the reference detector array and the data detector array provide currents in response to the ionization effect produced by substantially unattenuated and attenuated x-rays respectively; and
means for holding the space substantially at the same electric potential as the detector elements to inhibit electron accumulation in the space.

3. An ionization detector for the tomographic examination of an object by means of x-rays, comprising:
a substrate;
an array of data detector elements positioned on the surface of the substrate;
at least one array of reference detector elements positioned on the substrate surface and separated from the array of data detector elements by a space;
a plate facing the substrate surface in spaced, parallel relationship thereto;
means for applying a voltage between the plate and the detector elements to establish an electric field therebetween, the magnitude of the field being selected to cause free electrons produced by the ionization effect of the x-rays to travel to the detector elements, the presence of the electric field being further capable of causing electron accumulation within the space on the substrate surface; and
means for holding the space on the substrate surface at substantially the same electric potential as the detector elements to inhibit electron accumulation in the space;
whereby undesired arcing and electric field distortion in the vicinity of the space is substantially eliminated.

4. An ionization detector as recited in claim 2 in which the means for holding the space at the same electric potential as the detector elements comprises a conductor located within the space on the substrate surface electrically connected to ground.

5. An ionization detector as recited in claim 4 wherein the detector elements of each of the arrays comprise a plurality of elongated parallel conductors successively spaced in a row on the substrate surface.

6. An ionization detector as recited in claim 5 wherein the array of data detector elements is flanked by a pair of reference detector element arrays on the substrate surface each spaced from the data detector array and aligned therewith.

* * * * *